United States Patent [19]

Krusche

[11] Patent Number: 4,712,276

[45] Date of Patent: Dec. 15, 1987

[54] CARDING ROLLER FOR PROCESSING STAPLE FIBERS

[75] Inventor: Peter Krusche, Aachen, Fed. Rep. of Germany

[73] Assignee: Hergeth Hollingsworth GmbH, Duelmen, Fed. Rep. of Germany

[21] Appl. No.: 900,040

[22] Filed: Aug. 13, 1986

[30] Foreign Application Priority Data

Aug. 31, 1985 [DE] Fed. Rep. of Germany ..... 3531151

[51] Int. Cl.[4] ..... D01G 15/02

[52] U.S. Cl. ..... 19/99; 19/101

[58] Field of Search ..... 19/98, 99, 100, 101

[56] References Cited

U.S. PATENT DOCUMENTS

| | | | |
|---|---|---|---|
| 1,534,564 | 4/1925 | Bates | 19/99 |
| 2,835,929 | 5/1958 | Taine et al. | 19/99 |
| 3,470,586 | 10/1969 | Roberts | 19/99 |
| 3,983,273 | 9/1976 | Elliott | 19/99 X |

FOREIGN PATENT DOCUMENTS

| | | | |
|---|---|---|---|
| 2343064 | 3/1975 | Fed. Rep. of Germany . | |
| 2706348 | 8/1978 | Fed. Rep. of Germany . | |
| 3224118 | 1/1984 | Fed. Rep. of Germany . | |
| 8504429 | 10/1985 | World Int. Prop. O. | 19/98 |

OTHER PUBLICATIONS

Woolen Carding, 1968, pp. 5-26, published by Wool Industries Research Assoc., Headingley Lane, Leeds 6.

Krusche et al., How Does the Card Blend, Card, and Even Out?, Melliand Textilberichte, 2/83 (Part 1), p. 106, 3/83, (Part 2) p. 177.

Krusche, The Card: Carding or Levelling-An Analysis of the Carding Process, Nov. 84, pp. 671-673.

*Primary Examiner*—Louis K. Rimrodt

*Attorney, Agent, or Firm*—Cort Flint

[57] ABSTRACT

Carding roller apparatus for processing staple fibers is disclosed which includes rollers combined to form operative carding units (A) to provide a desired effect which may be combined to provide a desired levelling and carding of fibers. The operative units consist of a high speed roller (1, 5, 9, and 13) having a carding point with a working roller (2, 6, 10, and 14). There is a stripper roller (3, 7, 11, and 15) in advance if each working roller as seen in the travel direction. The first roller (1, 5, 9, and 13) is contacted by a fourth roller (4, 8, 12, and 16) which acts as a carding and transfer roller with fiber circulation and additional fiber storage between the next operative carding unit. By the additional carding points with fiber circulation and by the additional fiber storage, the apparatus provides improved levelling and opening qualities as compared to conventional carding arrangements.

10 Claims, 3 Drawing Figures

CARDING ROLLER FOR PROCESSING STAPLE FIBERS

BACKGROUND OF THE INVENTION

This invention is directed to apparatus for carding fibers. In the carding process, the carding apparatus straightens the fibers and arranges the fibers in a parallel relationship. The carded fibers are then output from the carding apparatus in the form of a web or in a condensed sliver. More particularly, the invention is directed to carding roller apparatus having a combination of small rollers which has a substantially higher levelling and carding capacity than the known machines. The carding roller apparatus provides improved quality of the fleece or web.

Typically, carding apparatus includes a large carding cylinder with four carding points arranged about the cylinder and a large doffer which removes the carded fibers from the cylinder.

Previous arrangements have also comprised small rollers which do not contain more carding points and do not store more fibers than the typical carding machine composed of a large carding cylinder, a doffer, and the usual working stations. The carding arrangement using small rollers operate partly without a fiber circulation about the working stations and the stripper roller is situated behind the working roller. Accordingly, increased carding and levelling capacities are not provided.

Accordingly, an object of the invention is to provide a carding apparatus having increased carding and levelling capacities to produce a web or sliver having improved qualities.

Another object is to provide a carding apparatus having a number of small rollers having an increased number of carding points and fiber circulation for improved blending and levelling of the fibers.

Still another important object of the present invention is to provide carding apparatus having a number of operative carding units each of which includes a number of small rollers having multiple carding points with fiber circulation wherein part of the fibers are transferred between the units while a remaining part of the fibers is stored improving carding and levelling capacities.

SUMMARY OF THE INVENTION

The above objectives are accomplished according to the present invention by providing a number of operative carding units arranged in tandem to achieve a desired levelling and carding effect. Each unit includes a high speed roller. A working station includes a worker roller contacting the high speed roller at a first carding point and a stripper roller in advance of the worker. A carding/transfer roller contacts the high speed roller for collection and carding at a first carding point. Some of the collected fibers are transferred by the carding/-transfer roller at a second carding point on the roller contacting the high speed roller of the adjoining operative unit. A fiber storage volume is maintained on the carding/transfer roller between the two carding points and the adjoining unit. The increased number of carding points and fiber storage volume enhance the carding and levelling properties.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

While the principles of the carding process and conventional carding process are well known in the art, only so much of the carding process and carding apparatus as is necessary to an understanding of the invention is illustrated herein.

Figure 1:
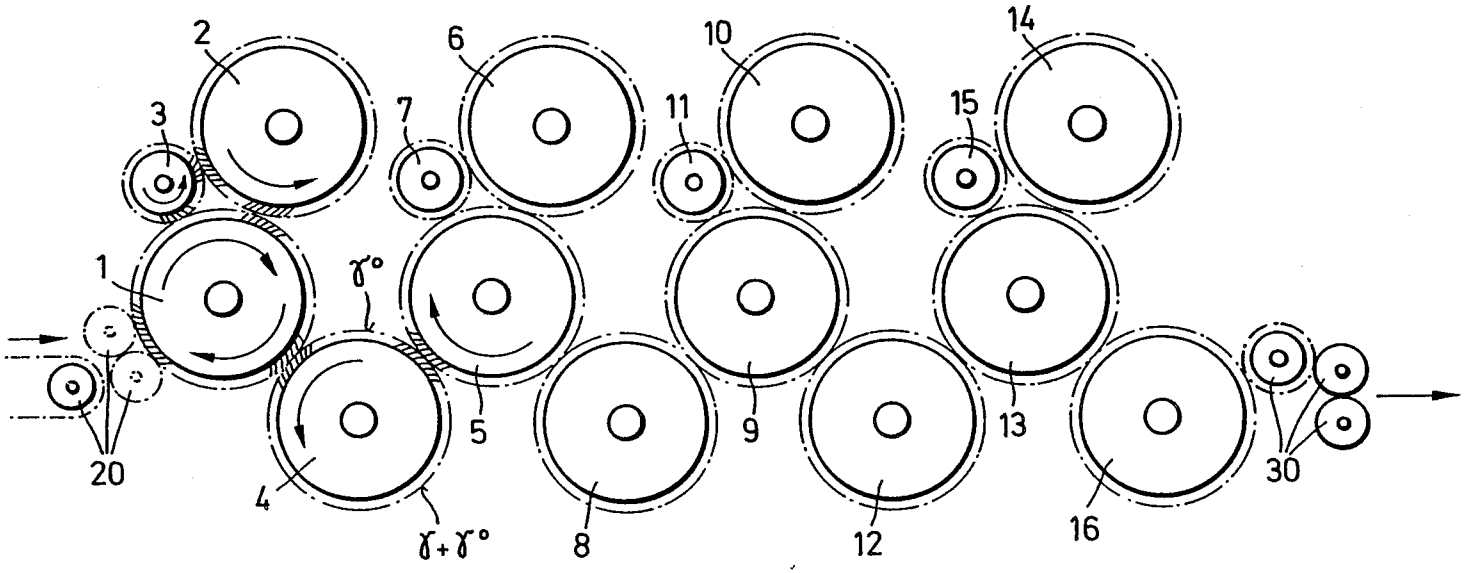
FIG. 1 is a schematic view illustrating carding roller apparatus constructed in accordance with the present invention wherein a number of operative carding units are arranged in series.

Accordingly, FIG. 1 illustrates a number of operative carding units A each of which includes four rollers which cooperate with each other in a carding process. There is a first, high speed roller 1. A working station is provided with a second, worker roller 2 and a third, stripper roller 3 with fiber circulation, i.e., the fibers are circulating repeatedly during the carding process at the working station. A fourth roller 4 contacts the high speed roller 1 and acts as a carding and transfer roller. The carding and transfer roller 4 transfers fibers from one operative unit to a next adjacent operative unit. The carding and transfer roller collects the fibers at a carding point from one high speed roller and delivers them at a carding point to the high speed roller of the next unit. For example, carding and transfer roller 4 collects fibers at a carding point at high speed roller 1 and transfers them at a carding point to high speed roller 5, as can best be seen in FIG. 1.

However, not all of the fibers are taken off a roller 4 at a carding point so that a certain filling amount $\gamma o$ (grams per meters squared) is constantly circulated. In this manner, roller 4 is used to store additional fibers in the amounts $\gamma$ plus $\gamma o$ (FIG. 1), thus becoming a carding roller having two carding points and an additional storage volume of fibers between the collection and transfer carding points for increased levelling. The same is true for rollers 8 and 12.

As can best be seen in FIG. 1, there are four operative units, having a high speed roller, stripper roller, worker roller, and carding and transfer roller. A first operative unit includes rollers 1–4. A second operative unit includes rollers 5–8. A third operative unit includes rollers 9–12; and a fourth operative unit includes rollers 13–16. Rollers 1, 5, 9, and 13 are high speed rollers. Rollers 2, 6, 10, and 14 are worker rollers. Rollers 3, 7, 11, and 15 are stripper rollers. Rollers 4, 8, 12, and 16 are carding and transfer rollers.

There are three carding points in each operative carding unit except at the exit unit where a carding point between rollers 16 and 30 is omitted for transfer whereby the exit unit includes two carding points. The entire system in FIG. 1 has eleven carding points.

Figure 2:
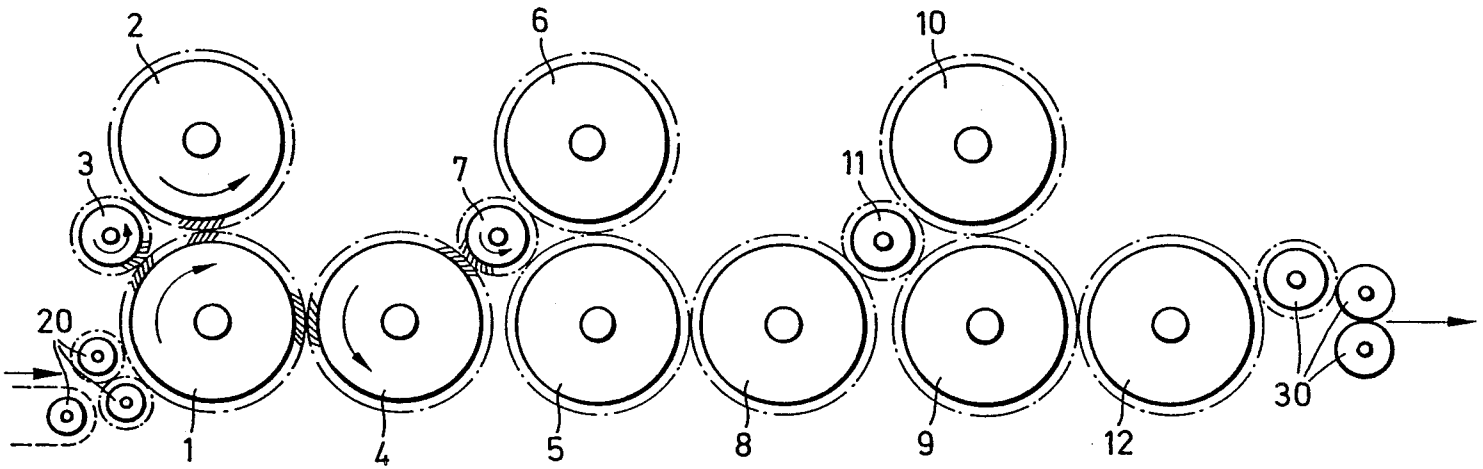
FIG. 2 is schematic illustration of carding roller apparatus according to an alternate embodiment of the invention.
Figure 3:
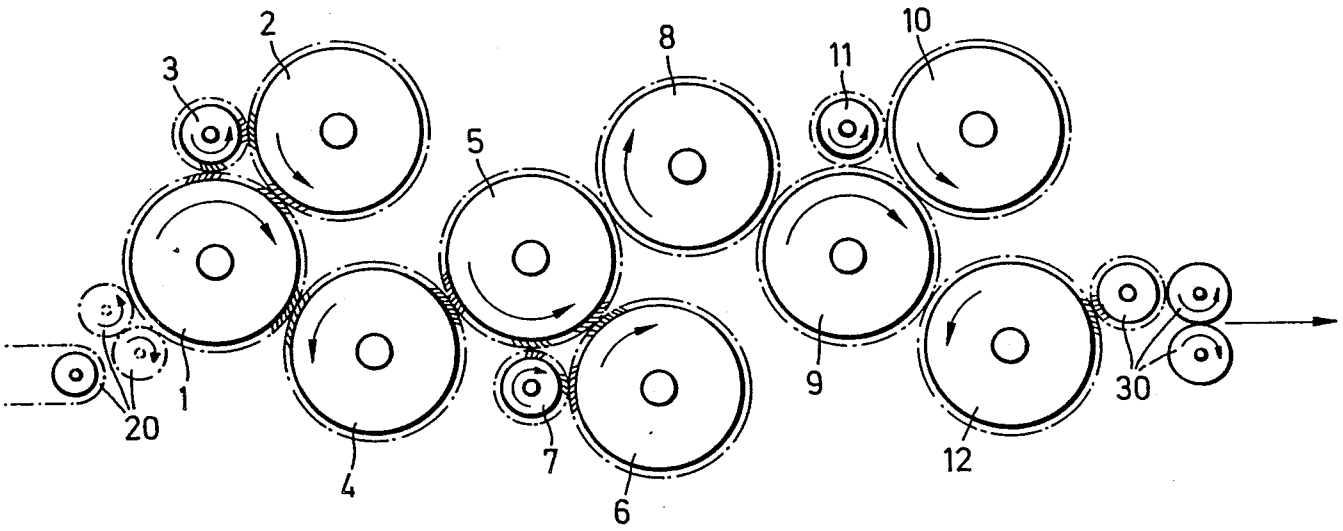
FIG. 3 is a schematic illustration of another embodiment of carding roller apparatus constructed in accordance with the present invention.

FIG. 2 illustrates an alternate embodiment where the stripper rollers 3, 7, and 11 are arranged to transfer fiber instead of the rollers 4, 8, and 12 eliminating a carding point at the rollers. FIG. 3 is another embodiment where the high speed rollers are arranged to transfer fiber in a combing action but which also eliminates a carding point at rollers 4, 8, and 12 (only three operative units are shown).

In advance of the operative carding units is a customary feed provided by a trough shaped or roller feed 20. At the end of the operative units at the last roller 16 in FIG. 1 and at the last roller 12 in FIGS. 2 and 3, there is a doffer roller 30 or a comb which are known in the art and act as doffers to remove the carded fibers.

In accordance with the present invention it is preferred that the operative units are composed of high speed, worker, and carding rollers having diameters of about three hundred millimeters (300 mm.) to four hundred millimeters (400 mm.), and of some smaller stripper rollers having diameters of one hundred twenty millimeters (120 mm.) to one hundred fifty millimeters (150 mm.).

As to the fiber carding points and storability of the present invention, a comparison may be made to a normal carding machine consisting of a large carding cylinder having four working or carding points and a large doffer. The conventional carding machine comprises four carding points with fiber circulation and one single carding point at the doffer, i.e., $4+1=5$ carding points.

In accordance with the carding roller apparatus illustrated in FIG. 1, the apparatus comprises four carding points with fiber circulation and six additional carding points with fiber circulation as well as a single carding point at the doffer which is roller 16 in FIG. 1, i.e., $4+6+1=11$ carding points. There is a carding point between the working roller and the high speed roller, and two carding points between the carding and transfer roller and the high speed roller of each operative unit as previously described above.

By omitting one carding point at the rollers 4, 8, and 12 in FIG. 1, and by using the stripper roller (FIG. 2) or high speed roller (FIG. 3) for fiber transfer, the resulting carding points are $4+3+1=8$.

Concerning the influence of the number of carding points on the carding property (CP), it is necessary to note that they are effected exponentially. This may be expressed mathematically as follows: $CP=P^Z$, when Z is the number of carding points and P is a separating factor for a fiber flock in the carding point.

The carding apparatus of the present invention is far superior to the normal carding machine with respect to the carding results. In this regards, it can be stated that the capability of a carding machine including levelling on unequal material is related to the capability of storing a fiber amount L (g). The influence of the amount L on the levelling capability is approximately expressed by factor f where $f=1/\sqrt{L_1/L_2}$ means the amount ratio of two cards under comparison. If card 1 stored double the amount of card 2, its levelling property is better by factor $f=1/\sqrt{2}=0.71$. A card storing four times the amount of another card reduces the unevenness of the material under processing by factor $f=0.5$. This is performed for a time of D seconds. $D=L/P$ (s). D is the average residence time of a fiber in the card, it is again dictated by the stored amount L. P is the production of the card in grams per second. Hence, the amount L is effective in two regards.

As for storability, the apparatus of the present invention will be superior to any other card by the amount being present on the rollers 4, 8, and 12. A normal card comprises working rollers having a diameter of about two hundred twenty millimeters (220 mm.) The apparatus of the present invention includes rollers having a diameter of three hundred (300 mm.) to four hundred (400 mm.) millimeters and the rollers will be adapted to store amounts double to four times higher.

While a preferred embodiment of the invention has been described using specific terms, such description is for illustrative purposes only, and it is to be understood that changes and variations may be made without departing from the spirit or scope of the following claims.

What is claimed is:

1. Carding roller apparatus of the type which includes a number of operative carding units each of which includes a plurality of rollers for processing staple fibers; wherein said operative carding units are arranged in tandem to provide a desired effect of the carding and levelling capacity; and each operational unit consisting of four rollers which cooperate with each other in the carding process which include a high speed roller, a working roller contacting said high speed roller at a carding point with fiber circulation, a stripper roller disposed in advance of the working roller in the travel direction of said rollers, a carding and transfer roller contacting the high speed roller at a carding point with fiber circulation and for assisting in the transfer of fibers from one said operative carding unit to an adjoining operative carding unit, said carding and transfer roller including a second carding point at the next adjoining operative carding unit with fiber circulation and an additional fiber storage volume between said first and second carding points to provide increased blending and levelling of fibers, and said working roller and high speed roller having generally equal diameters.

2. The apparatus according to claim 1 wherein said stripper roller is arranged between adjoining operative carding units to transfer fibers from one operative carding to a next adjoining operative carding unit.

3. The apparatus according to claim 1 wherein the transfer of fibers from one operative carding unit to the next adjoining operative carding unit is performed by the high speed roller which is arranged at each operative carding unit to transfer fibers.

4. The apparatus according to claim 1 wherein said four rollers of each operational unit are sized and arranged relative to one another and to adjacent operational units such that generally all the operational carding space about the periphery of said high speed roller is taken up.

5. Carding roller apparatus of the type which includes a number of operative carding units each of which includes a plurality of rollers for processing staple fibers; wherein said operative carding units are arranged in tandem to provide a desired effect on the carding and levelling capacity; and each operational unit comprising four rollers which cooperate with each other in the carding process which include a high speed roller, a working roller contacting said high speed roller at a carding point with fiber circulation, a stripper roller disposed in advance of the working roller in the travel direction of said rollers, a carding and transfer roller contacting the high speed roller at a carding point with fiber circulation and for assisting in the transfer of fibers from one said operative carding unit to an adjoining operative carding unit, and said high speed roller has a diameter generally equal to the diameter of said working roller.

6. The apparatus of claim 5 wherein said carding and transfer roller includes a second carding point at the next adjoining operative carding unit with fiber circulation and an additional fiber storage volume between said first and second carding points to provide increased blending and levelling of fibers.

7. The apparatus according to claim 5 wherein said stripper roller is arranged between adjoining operative carding units to transfer fibers from one operative carding to a next adjoining operative carding unit.

8. The apparatus according to claim 5 wherein the transfer of fibers from one operative carding unit to the next adjoining operative carding unit is performed by the high speed roller which is arranged at each operative carding unit to transfer fibers.

9. The apparatus of claim 5 wherein said high speed roller, working roller, and carding and transfer roller are generally all the same size.

10. The apparatus of claim 5 wherein said high speed roller, working roller, and carding and transfer roller are the same diameter and said diameter is between about 300 millimeters and 400 millimeters.

* * * * *